US005987913A

United States Patent [19]

Andrzejczak

[11] Patent Number: 5,987,913

[45] Date of Patent: Nov. 23, 1999

[54] MULTI-SERVING CEREAL TRANSPORT

[76] Inventor: Stanley Andrzejczak, 8590 Peffer Rd., Fairview, Pa. 16415

[21] Appl. No.: 09/164,070

[22] Filed: Sep. 30, 1998

Related U.S. Application Data

[60] Provisional application No. 60/061,009, Oct. 6, 1997.

[51] Int. Cl.[6] ..... F25D 3/08

[52] U.S. Cl. ..... 62/457.2; 62/371; 215/12.1

[58] Field of Search ..... 62/457.2, 457.6, 62/371, 372; 215/12.1; 220/301; 99/516

[56] References Cited

U.S. PATENT DOCUMENTS

| | | | |
|---|---|---|---|
| 922,125 | 5/1909 | Friedrich | 215/12.1 |
| 2,711,866 | 6/1955 | Archer et al. | 220/62.18 |
| 2,756,889 | 7/1956 | Bramming | 215/12.1 |
| 4,393,975 | 7/1983 | Moore | 206/385 |
| 4,401,245 | 8/1983 | Zills | 224/148.3 |
| 4,974,423 | 12/1990 | Pring | 62/371 |
| 5,241,835 | 9/1993 | Ascone | 62/372 |
| 5,600,958 | 2/1997 | Henning et al. | 62/60 |
| 5,709,105 | 1/1998 | Palermo | 62/457.4 |
| 5,871,116 | 2/1999 | Picchietti | 220/501 |
| 5,934,099 | 8/1999 | Cook et al. | 62/457.2 |

*Primary Examiner*—Henry Bennett
*Assistant Examiner*—Melvin Jones
*Attorney, Agent, or Firm*—Richard K. Thomson

[57] ABSTRACT

A stackable group of containers permit transport of up to 2½ cups of cereal, at least 5 oz of fruit, at least 10 teaspoons full of sugar, up to 12 oz of milk which is kept chilled for up to 8 hours by a freezable cup, each is a separate compartment. The three principle components include an insulated compartment, a cereal bowl unit, and a cereal container, each element nesting within the next successively named element. The cereal bowl unit has individual compartments for fruit and sweetener which threadingly engage other members of the bowl unit, the unit itself threading onto the cereal container. A single serving transport can be created using the cereal bowl unit and a bowl liner which alternatively snaps onto the top of the insulated compartment, when used, or the cereal bowl unit to form the single serving transport. When the full stackable group is used, a tote bag with a draw string can be used for carrying convenience and providing added thermal insulation.

20 Claims, 2 Drawing Sheets

MULTI-SERVING CEREAL TRANSPORT

This application claims the benefit of provisional application Ser. No. 60/061,009 filed Oct. 6, 1997 by the Applicant hereof.

The present invention is directed to a device for transporting one or more servings of cereal, fruit, sweetener and, if not otherwise available, milk to provide a healthy meal or snack.

BACKGROUND AND SUMMARY OF THE INVENTION

In America alone, people consume approximately 3 billion boxes of cereal per year. The bulk of that cereal is eaten at home. It is submitted that the primary reason for this is that transporting the necessary elements, i.e., a thermos bottle of milk, a container of cereal, a bowl, a spoon, a container of fruit, a supply of sugar or other sweetener, has, until now, been so cumbersome and troublesome to assemble the components as to make cereal an unattractive option for midday meal or snack. In addition, there is the significant problem of cleaning up the milk container and cereal bowl at school or work or allowing the milk to sour until returning home. This avoidance of cereal for meals away from home is in spite of the fact that cereal has nutritional advantages over other food options and would actually be preferred by a significant number of children and adults if the logistical hurdles could be overcome.

One attempt to make taking cereal for lunch more attractive is set forth in U.S. Pat. No. 5,241,835 issued to David Ascone and reissued as Re. 35,437. The Ascone invention consists of a two compartment container interconnected by an orifice that has a valve 18 controlling flow of milk from a first compartment 12 to the second compartment 14 where the cereal is stored. A freeze pack 17 can be utilized to keep the milk chilled and removable cap 26 affords access to the second compartment for consuming the cereal and milk. This attempted solution has its limitations. Once the valve is opened, all the cereal in compartment 14 will be wetted and must be eaten. Further, the flow orifice is difficult to access and, therefore, hard to clean. Thirdly, the Ascone device lacks provision for separately transporting servings of fruit and sweetener. Lastly, Ascone's device would not be usable with a hot cereal since the cereal container could not be microwaved apart from the milk storage compartment and freeze pack.

The present invention overcomes these difficulties providing a compact, convenient device for transporting and serving as many as five healthy servings of cereal with fruit topping, or the like. The device, which may be marketed under the trademark STACK N' SACK, includes three principle components: a) a cereal container for receiving and transporting at least one serving of cereal; b) a separate cereal bowl unit; and c) an insulated compartment for maintaining a container of milk chilled. The insulated compartment has at least a gel pack portion which can be frozen and then inserted in the compartment to maintain a container of milk chilled for a period as long as 8 hours. Preferably, the insulated compartment comprises a freezable cozy, a cylindrical cup which can be inserted in a freezer and then placed around a milk container. The separate cereal bowl unit includes a first compartment which can receive a serving of cereal, a second compartment which is threadably attachable to the first which can hold a serving of fruit, yogurt or the like, and a third compartment, which can store a measured amount of sugar, brown sugar, or artificial sweetener, which can be threadably interconnected to the second compartment. The interconnecting threads are of the same pitch and the elements of the same diameter so that the fruit container, for example, can be omitted and the sweetener compartment attached directly to the cereal bowl. The cereal container can hold multiple servings of cereal which can be sequentially poured into the bowl unit for eating a serving at a time.

The milk container, which holds 12 oz of milk is a cylindrical vessel having an open top which is closed by a closure top threadably attachable to said cylindrical container, said closure top having a smaller pouring orifice which is sealed by a flip-top cap. A disk insert affords additional flexibility for the device's use. The disk can be inserted between the cylindrical freezable cozy and a plastic cap which engages an upper rim of the cozy to reduce the size of the opening in the top so the cozy can accommodate a smaller milk container such as a commercially available bottle or carton or a soon to be released new product known as "Chugs".

The three main components can be interconnected to form a unit which approximates the size of a conventional thermos, 3¾" in diameter by 10½" tall. The insulated compartment nests within cereal bowl unit and is separated from the fruit compartment by only the uninsulated bottom of the cereal bowl. In this manner, the gel pack can chill the fruit compartment as well as keep the milk container cold. The compressible insulation surrounding the insulated compartment is squeezed into the cereal bowl and this provides a frictional retention force that keeps these two of the three principle components interconnected. The cereal bowl unit nests within the cereal container and a downwardly protruding flange on the bowl, which partially surrounds a pedestal thereof, threads onto an upper rim of the cereal container to maintain the container engaged with the other two components. A cereal bowl liner which can be disposable, is inverted and snapped over the top of the insulated compartment after the milk container is inserted therein. The cereal bowl liner can be turned upright and inserted in the cereal bowl so that cereal can be eaten from the bowl liner and the liner discarded to eliminate the need for washing. A cloth bag or sack receives the stacked components and a pull string closes the top of the bag and helps retain the stack as a transportable unit. In addition, tests have indicated the bag affords additional insulation that helps keep the milk chilled until use.

Should the consumer have access to a supply of milk, through a school milk program or the like, the cereal bowl unit can be filled with a single serving of cereal, fruit placed in its compartment and sweetener in its, and the bowl liner snapped to the top of the bowl. Alternatively, sweetener could be added to the fruit compartment or the fruit compartment omitted since the threads on the caps and pedestals make interconnection interchangeable. This individual cereal server which is 3 ¾" in diameter and 3" tall, can be easily fit into a lunch box with other lunch items.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
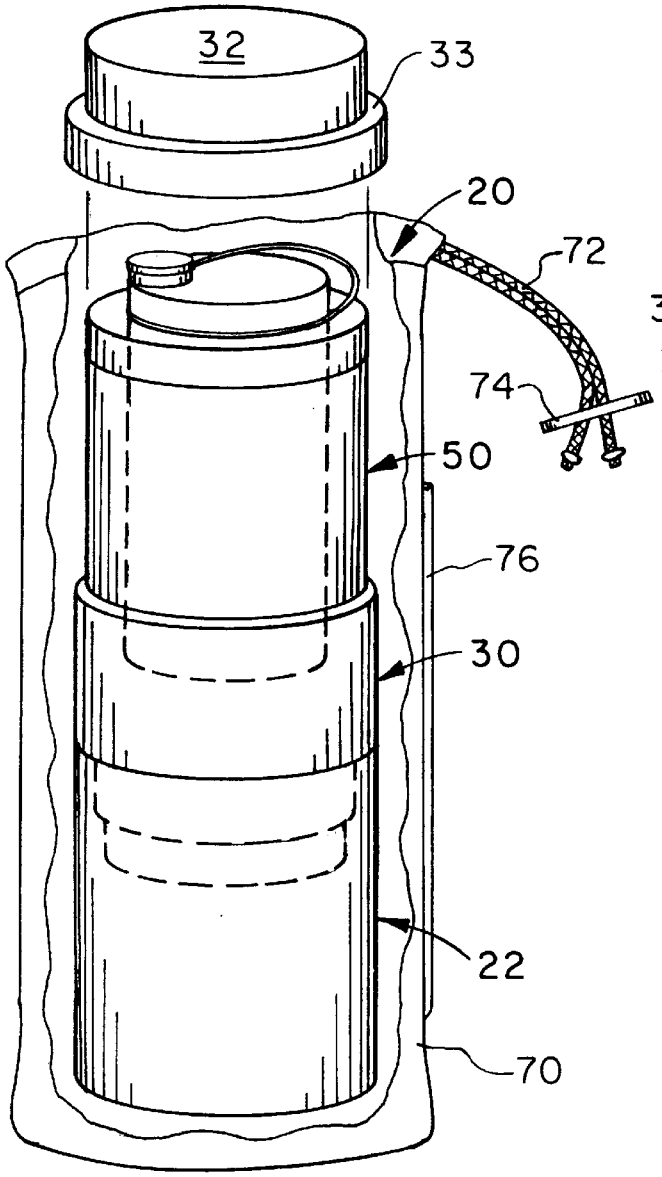
FIG. 1 is a perspective view of a first embodiment of the multi-serving cereal transport of the present invention.

The multi-serving cereal transport of the present invention is shown in FIG. 1 generally at 20. Cereal transport 20 is comprised of three principle components: 1) a cereal container 22 shown in FIG. 1, 2) a cereal bowl unit 30 shown in detail in FIG. 2A, and 3) an insulated compartment 50 shown in detail in FIG. 2B. All components are both dishwasher safe and microwave safe as well as child friendly (no small swallowable parts or sharp edges). Two of the three major components nest in an adjacent component: insulated compartment 50 nests within cereal bowl unit 30 which in turn, nests in cereal container 22. A cereal bowl liner 32 can be inverted and snapped onto the top of insulated compartment 50 and the entire assembled transport 20 inserted into a tote bag 70 which has a draw string 72 with a securing toggle 74. The fully assembled transport 20 is generally the size of a conventional thermos, being 3¾" in diameter and standing 10½" tall. A pocket 76 in bag 70 has adequate space to hold a spoon, a napkin and a banana.

Figure 2A:
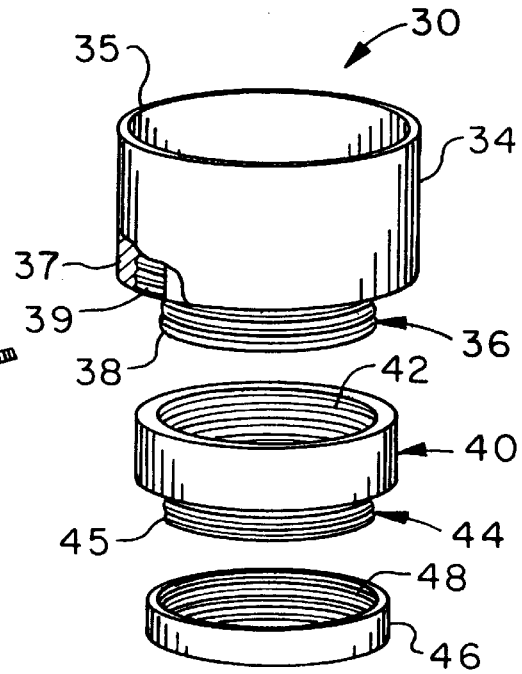
FIG. 2A is an exploded perspective view of the cereal bowl unit of the present invention.
Figure 2B:
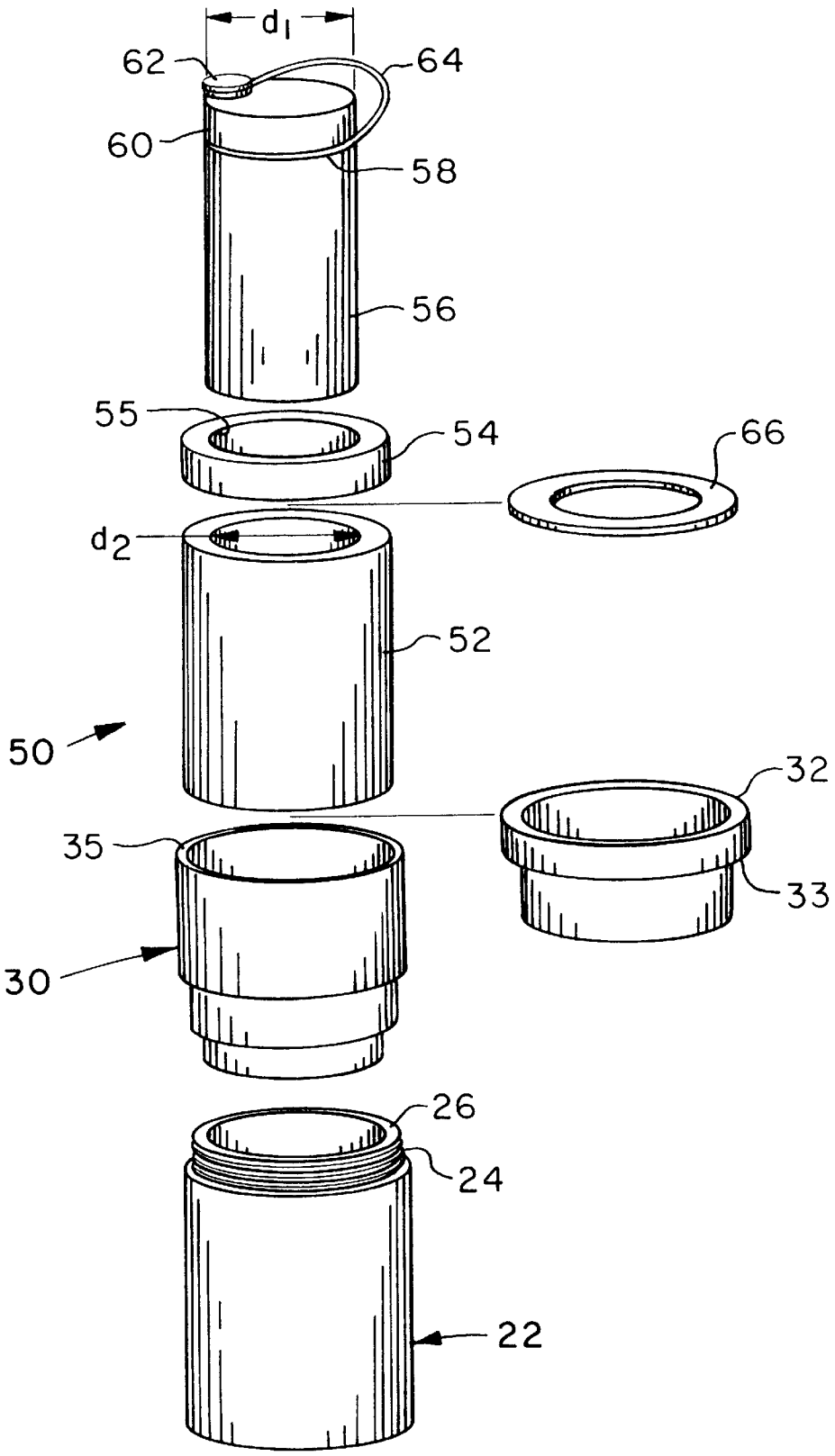
FIG. 2B is an exploded perspective view of the remaining components of the cereal transport of the present invention.

Cereal bowl unit 30, shown best in FIG. 2A, has three principle components: cereal bowl 34, fruit container 40, and sweetener compartment 46. Cereal bowl 34 can be used to receive the cereal and milk for consumption. However, a plastic bowl liner 32 can be nested in bowl 34 until flange 33 of liner 32 rests on the top 35 of bowl 34. The bowl liner 32 can be simply discarded after use or may be easily rinsed for subsequent reuse. Cereal bowl 34 has a pedestal 36 with external threads 38. An inwardly directed set of threads 39 are formed on a flange 37 surrounding pedestal 36. Pedestal 36 is preferably hollow for reasons to be discussed herein. Fruit container 40 is sized to hold approximately 5 oz. of fruit and has internal threads 42 which can threadably engage threads 38 on pedestal 36. A pedestal 44 which also preferably has a hollow stem, has external threads 45. Sweetener compartment 46 can hold about 10 teaspoons full of sugar, brown sugar, honey, EQUAL, or other natural or artificial sweetener. Sweetener compartment 46 has internal threads 48 which can threadingly engage threads 45 on pedestal 44 to secure compartment 46 to fruit container 40. While cereal bowl unit 30 has been depicted as employing conventional threads 24, 38, 39, 42, 45, 48, it is actually preferred that these threads be of a single turn or half-turn variety for ease in connection and disconnection of the respective elements.

It is preferred that the serving of fruit, which could be a fruit flavored yogurt or other cereal topping, and sweetener be loaded into their respective containers by inverting the cereal bowl unit 30 and filling the hollow pedestals 36 and 44, respectively. This will avoid the fouling of threads 38, 42 and 45, 48 as the parts are interconnected. When opening the fruit container 40 and sweetener compartment 46, each will be unscrewed from its mating component while in the upright position receiving the contents and, as such, acting as serving bowls therefor while dining. The possibility of fouling the threads during reassembly will be significantly reduced as a result of a some portion or all of the contents of compartments 40 and 46 having been consumed.

Insulated compartment 50 includes a freezable gel pack in the form of cup 52 and a plastic cap 54 which can frictionally engage the outer surface of milk container 56. Container 56 is generally cylindrical having an outer diameter $d_1$. The mouth 58 of container 56 has a diameter substantially equal to that of the container 56. This wide mouth 58 facilitates easy cleaning. Container 56 holds approximately 12 oz of milk. Closure top 60 threads onto the top of container 56 and has a smaller pour orifice closed by a flip-top cap 62 that is attached to closure top 60 by plastic attachment 64. Cup 52 has an inner diameter $d_2$ which is less than $d_1$ and inner circumference 55 of cap 54 retains container 56 in the center of cup 52 with an insulated airspace surrounding the container 56.

A reducer ring 66 is provided so that freezable cup 52 can be used to keep other commercially available containers, bottles or cartons, of milk cold in lieu of using container 56. By doing so, the milk container and bowl liner 32 could be simply discarded and the need to wash any portion of the cereal transport 20 would be obviated. Freezable cup 52 has a compressible insulation on its circumferential exterior by which cap 54 and bowl unit 30 are retained engaged with cup 52. Only the uninsulated bottom of bowl 34 separates the fruit in fruit container 40 from the freezer cup 52 so cup 52 also doubles as a refrigeration unit for fruit container 40. Cup 52 can obviously be used as a can cozy around the house. The refrigeration for the milk and fruit could be provided by a removable gel pack insertable into the base of cup 52 with some loss of cooling effectiveness. As an alternative to ring 66, cap 54 could have inwardly extendable and retractable tabs which would allow it to accommodate milk containers of a variety of sizes.

Cereal container 22 has external threads 24 around its upper rim which will engage threads 39 on flange 37 of cereal bowl 34 to retain the bowl unit 30 connected to cereal container 22. Container 22 will hold approximately 2½ cups of cereal while still affording sufficient clearance for the nesting of cereal bowl unit 30 therein.

While cereal transport 20 is particularly adapted for use with cold cereal, it is equally useful with hot cereal. A packet of instant cereal can be mixed with a suitable quantity of water or milk in bowl liner 32 or in cereal bowl 34 and placed in a microwave for the prescribed time. Milk sweetener and fruit can be added from containers 56, 46 and 40, respectively.

The cereal transport 20 of the present invention will enable the user to transport up to five servings of cereal, 12 oz of milk, 5 oz or more of fruit or other cereal topping and 10 teaspoons of sweetener while only occupying the space of a conventional thermos bottle. Tote bag 70 makes STACK N' SACK transport easy to carry. In addition, experiments have shown that the insulating properties of the bag 70 can add up to two hours additional to the period the milk remains chilled (up to 8 hours total).

If milk is otherwise available to the user and only a single serving of cereal is desired, perhaps as one course of a lunch for example, bowl 34 can be filled with cereal, fruit container 40 with fruit or other topping, and compartment 46 with sweetener with 40 and 46 inverted as noted earlier (FIG. 2A). The inverted cereal bowl liner 32 (FIG. 1) can be snapped onto the top of cereal bowl unit 34 and the single cereal serving unit which has a height of only 3" can be inserted into a lunch box or bag.

Various changes, alternatives and modifications will become apparent to one of ordinary skill in the art following a reading of the foregoing specification. For example, while the device has been described in connection with transporting cereal, it will be appreciated that other food could alternatively be used with this device. For example, salad could be retained in the first compartment, croutons or salad dressing in the second and bacon bits and/or cheese in the third. It is intended that any such changes, alternatives and modifications as fall within the scope of the appended claims be considered part of the present invention.

I claim:

1. A device for transporting and serving at least one serving of cereal comprising a) a cereal container for receiving said at least one serving of cereal for transport;

b) a cereal bowl unit into which said at least one serving can be poured for serving;

c) an insulated compartment for maintaining a vessel of milk chilled, said insulated compartment defining a first chilled compartment;

whereby each of said elements a), b), and c) are individual separate elements including means for interconnecting said elements into a compact stack for transport, said separate elements being disconnectable for serving said at least one serving of cereal with milk within said cereal bowl unit.

2. The device of claim 1 wherein said means for interconnecting said individual separate elements comprise means for nesting portions of two of said elements in portions of two other of said elements.

3. The device of claim 2 wherein a first portion of said insulated compartment nests in a first portion of said cereal bowl unit and a second portion of said cereal bowl unit nests in a first portion of said cereal container.

4. The device of claim 3 wherein said cereal bowl unit is threadably attached to an upper rim portion of said cereal container.

5. The device of claim 1 wherein said cereal bowl unit further comprises an open-topped cereal bowl and a fruit container threadably attachable to a base portion of said open-topped cereal bowl, said cereal bowl being uninsulated such that the bottom of the open-topped cereal bowl forms an interface between said frit container and said insulated compartment providing a second chilled compartment.

6. The device of claim 5 wherein said cereal bowl unit further comprises a sweetener container threadably attachable to a base portion of said fruit container.

7. The device of claim 1 wherein said insulated compartment further comprises a cylindrical sleeve with a closed bottom for receiving a milk container, a gel pack which can be frozen, and a separable cap which snaps onto an upper portion of said sleeve to grip a portion of said milk container and maintain said container in spaced relationship to a wall portion of said cylindrical sleeve to provide an insulated air space between said sleeve and said milk container.

8. The device of claim 7 further comprising a diameter-reducing ring insertable between said cylindrical sleeve and said cap to accommodate a reduced size milk container.

9. The device of claim 7 wherein said gel pack is integral within said cylindrical sleeve and said entire unit is placed in a freezer compartment for chilling.

10. The device of claim 7 wherein said cylindrical sleeve has an outer layer of collapsible foam insulation, said outer layer of collapsible insulation fitting snugly within said separate bowl unit as a means of retaining said elements in a connected stack.

11. The device of claim 1 wherein said separate cereal bowl unit comprises said open-topped cereal bowl which defines a first compartment for receiving a serving of cereal, a second compartment for storing a serving of fruit, and a third compartment for storing a measured amount of sweetener.

12. The device of claim 11 further comprising a disposable bowl liner which can be nested within said open-topped cereal bowl from which said cereal may be served, said disposable bowl liner, during transport, serving as a cap which snaps over said insulated compartment containing said chilled milk.

13. The device of claim 12 wherein said separate bowl unit and said disposable bowl liner may be utilized to form a container for a single serving of cereal by filling said first compartment of said open-topped cereal bowl with said single cereal serving, inverting said bowl liner and snapping it to a top portion of said bowl unit.

14. The device of claim 1 wherein said cereal container has a capacity for receiving a plurality of servings of cereal.

15. The device of claim 1 further comprising a carrying sack which receives a stack of said interconnected elements, said carrying sack including a pull string closure and at least one pocket for a spoon, a banana, and the like.

16. The device of claim 1 further comprising a cylindrical container of a first diameter for receiving a quantity of milk, said container having a) an open mouth having a size equal to said first diameter, b) a closure top threadably attachable to said cylindrical container, said closure top having a smaller pouring orifice which is sealed by a flip-top cap.

17. A device for transporting and serving at least a single serving of a healthy food such as cereal comprising a) a bowl unit including i) a first compartment for receiving a serving of said healthy food;

ii) a second compartment interconnectable to said first compartment for transporting a serving of a first topping such as fruit;

iii) a third compartment interconnectable to said second compartment for transporting a second topping such as a supply of sweetener;

b) a bowl liner for receiving a combination of at least a portion of said serving of healthy food, at least a portion of said serving of said first topping and at least a portion of said supply of said second topping for consumption, said bowl liner snapping onto an upper region of said bowl unit in an inverted position to form an easily transportable unit;

whereby said at least a portion of said serving of said healthy food, said at least a portion of said serving of said first topping and said at least a portion of said supply of said second topping can be consumed from said bowl liner and said bowl liner can be discarded or rinsed.

18. The device of claim 17 further comprising a container capable of receiving a plurality of servings of said food, said bowl unit being nestable in a top portion of said container to form an easily transportable package.

19. The device of claim 18 further comprising an insulated compartment for maintaining a vessel of milk chilled, said insulated compartment being nestable in a top portion of said bowl unit to form an easily transportable package.

20. The device of claim 19 further comprising a cylindrical container of a first diameter for receiving a quantity of milk, said container having a) an open mouth having a size equal to said first diameter, b) a closure top threadably attachable to said cylindrical container, said closure top having a smaller pouring orifice which is sealed by a flip-top cap.

* * * * *